United States Patent [19]

Miller

[11] 4,023,157

[45] May 10, 1977

[54] THEFT ALARM FOR PORTABLE ARTICLES

[75] Inventor: Albert J. Miller, Santa Clara, Calif.

[73] Assignee: Engineering Systems Corporation, Santa Clara, Calif.

[22] Filed: Oct. 18, 1976

[21] Appl. No.: 733,060

Related U.S. Application Data

[63] Continuation-in-part of Ser. No. 604,882, Aug. 14, 1975, abandoned.

[52] U.S. Cl. ..... 340/280; 340/282; 340/283

[51] Int. Cl.[2] ..... G08B 13/14

[58] Field of Search ..... 340/283, 280, 282; 248/226 D, 226 C

[56] References Cited

UNITED STATES PATENTS

| | | | |
|---|---|---|---|
| 2,724,823 | 11/1955 | Toepfer | 340/283 |
| 2,826,656 | 3/1958 | Gordon | 340/283 |
| 3,327,300 | 6/1967 | Birrenkott | 340/283 |
| 3,597,753 | 8/1971 | Tabankin | 340/283 |
| 3,644,921 | 2/1972 | Duggan et al. | 340/283 |

*Primary Examiner*—Glen R. Swann, III
*Attorney, Agent, or Firm*—Harris Zimmerman

[57] ABSTRACT

A theft alarm for portable articles includes a pocket-sized housing from which extend a pair of opposed, pivotting jaws. One of the jaws is secured to an extendable ratchet shaft disposed within the housing. A cam rotated by a key lock device actuates a pawl which selectively retains the ratchet to lock the jaws about the article. The cam also actuates a leaf switch which activates a motion-sensing electronic circuit. The circuit actuates a pulsating audible alarm whenever the article is moved.

15 Claims, 13 Drawing Figures

THEFT ALARM FOR PORTABLE ARTICLES

REFERENCE TO RELATED APPLICATION

This application is a continuation-in-part of application Ser. No. 604,882, filed Aug. 14, 1975, now abandoned.

BACKGROUND OF THE INVENTION

In the present moral climate the wind of change is eroding the traditional respect accorded an individual's right to retain private property. At the same time, there has been a proliferation of valuable, portable articles which are hightly susceptible to theft. These articles include motorcycles, camping equipment, radios and televisions, and skis. Particularly in the case of skis, which are often left unattended in the presence of a throng of people, theft is unfortunately quite common. There is no effective means for a skier to protect his equipment, as a chain and lock is far too unwieldy to be carried on the slopes, and no suitable alarm device exists to protect the skis.

SUMMARY OF THE INVENTION

The present invention generally comprises a theft alarm which is particularly adapted to protect small, valuable, portable articles such as skis. The device, one clamped to the article, cannot be removed except by the authorized user. When armed, the device will sense any movement of the article and will emit a loud, pulsating alarm as long as the movement is continued, rendering any attempted theft obvious to the owner and any bystanders.

The device includes a rugged, pocket-sized rectangular housing which contains a motion-sensing switch, a sound transducer and associated electronic circuitry, and a key lock device. Extending from opposed sides of the housing are a pair of rotatable jaws for securing the device to the article to be protected. One of the jaws is secured to a ratchet shaft which is extendable from the housing. A pawl operatively associated with the ratchet is actuated by the key lock to lock the ratchet in place and secure the jaws about the article.

The key switch is also adapted to actuate the switch which arms the alarm circuitry. Thereafter any motion imparted to the device will open the motion sensing switch, which will in turn actuate the alarm circuitry. The alarm will sound for a short period of time, approximately two seconds, and then will cease. Continued motion after that time will re-actuate the alarm. Thus incidental motion such as accidental jostling or wind shock will cause only a short burst of the alarm, but continued motion such as that imparted by a thief carrying off the article will result in a continued, pulsating alarm sound which will be quite noticeable both to the thief and to anyone nearby.

THE DRAWING

Figure 4:
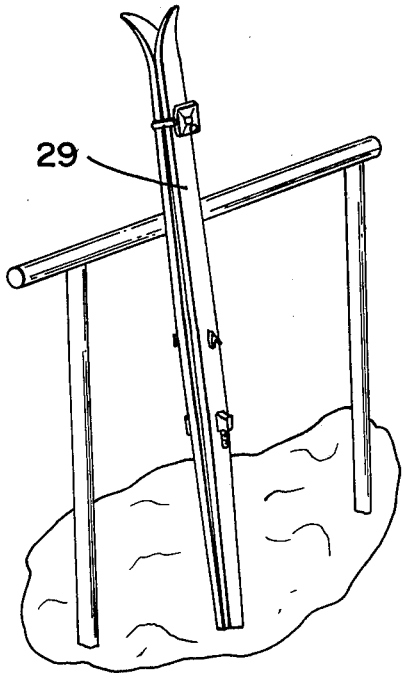

FIG. 4. is a perspective view of the alarm device of the present invention secured to a pair of skis.

Figure 5:
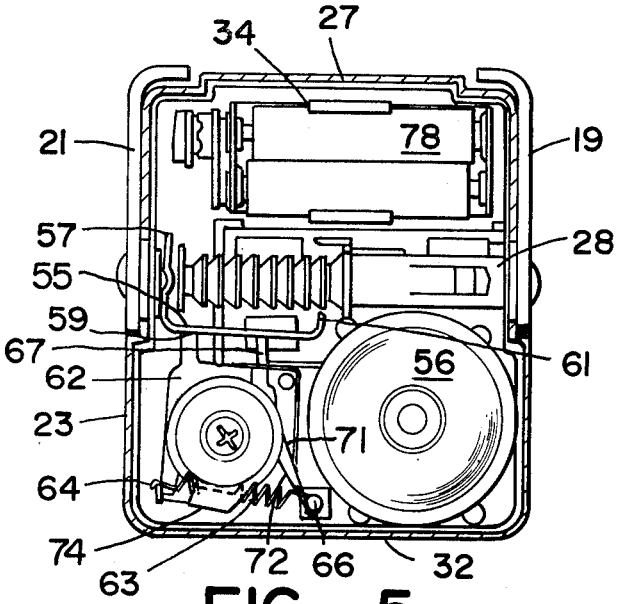

FIG. 5 is a top cutaway view of the alarm device of the present invention.

Figure 6:
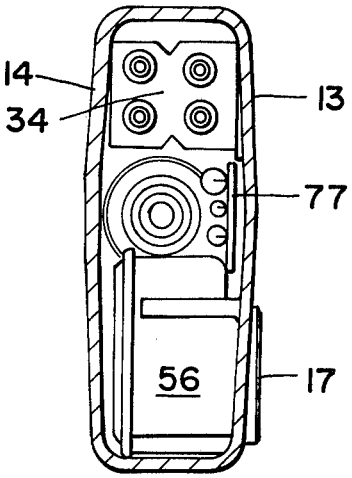

FIG. 6 is a side cutaway view of the alarm device of the present invention.

Figure 7:
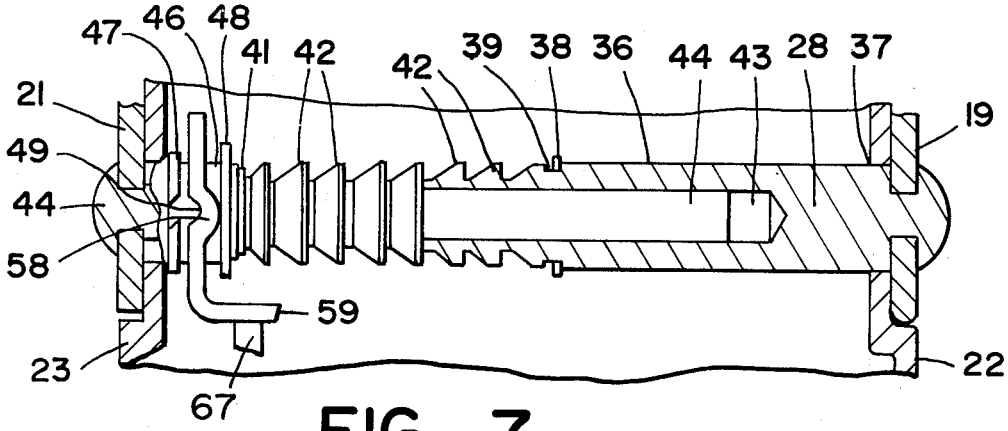

FIG. 7 is a detailed view of the ratchet portion of the alarm device of the present invention.

Figure 8:
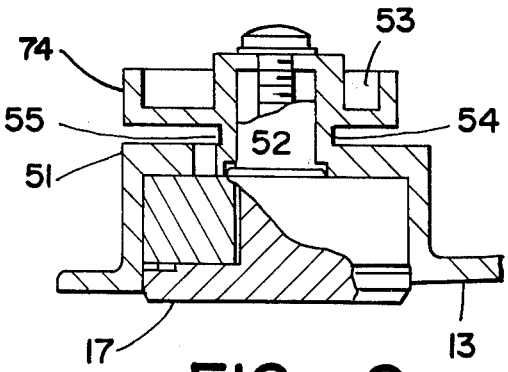

FIG. 8 is a side cross-sectional elevation of the key lock portion of the present invention.

Figure 9:
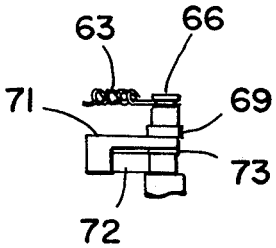

FIG. 9 is a detailed side view of the leaf switch of the present invention.

Figure 10:
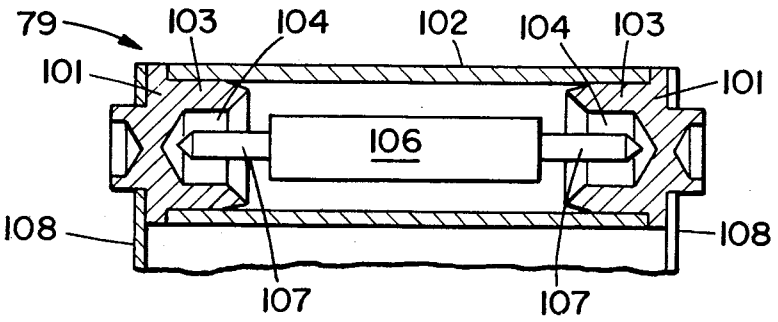

FIG. 10 is a detailed cross-sectional view of the motion sensing switch of the present invention.

Figure 11:
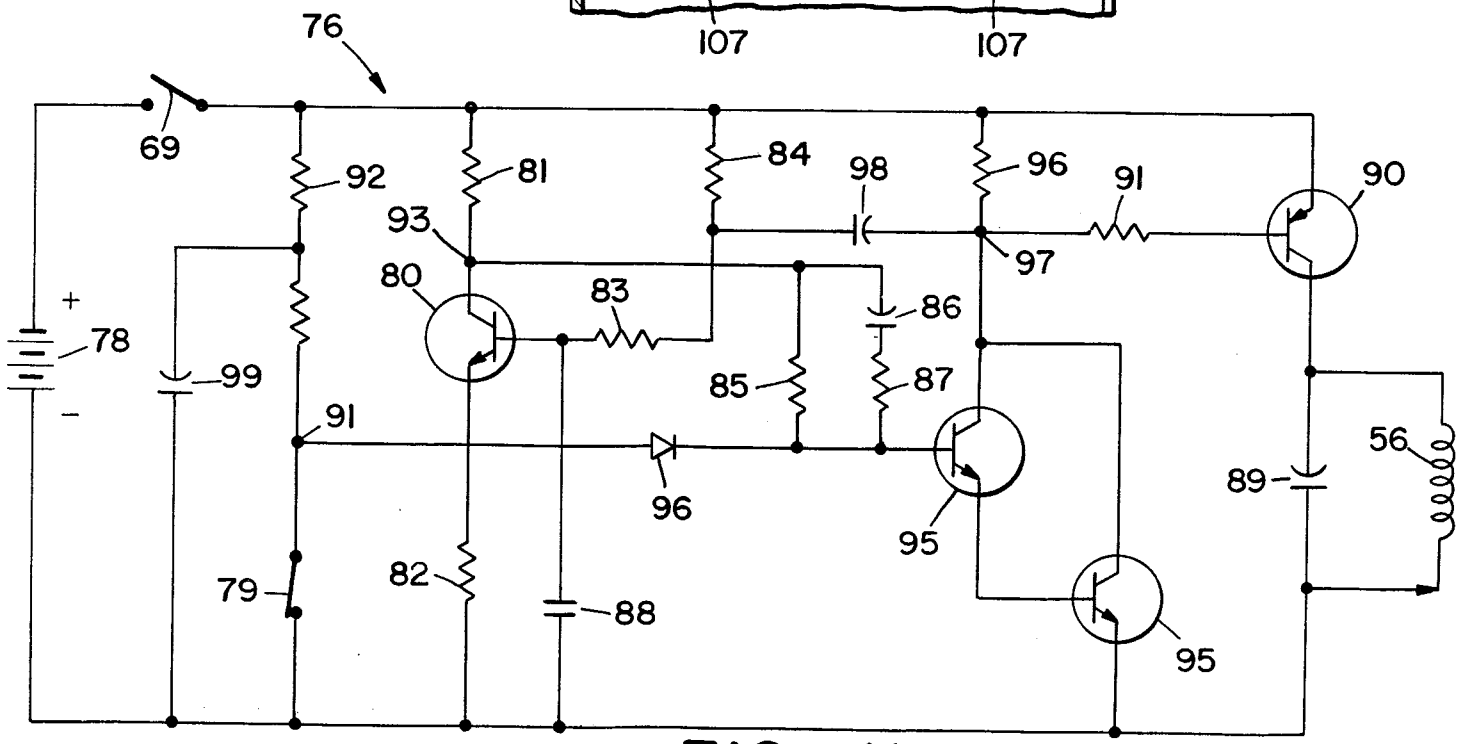

FIG. 11 is a schematic representation of the electronic circuit of the present invention.

Figure 12:
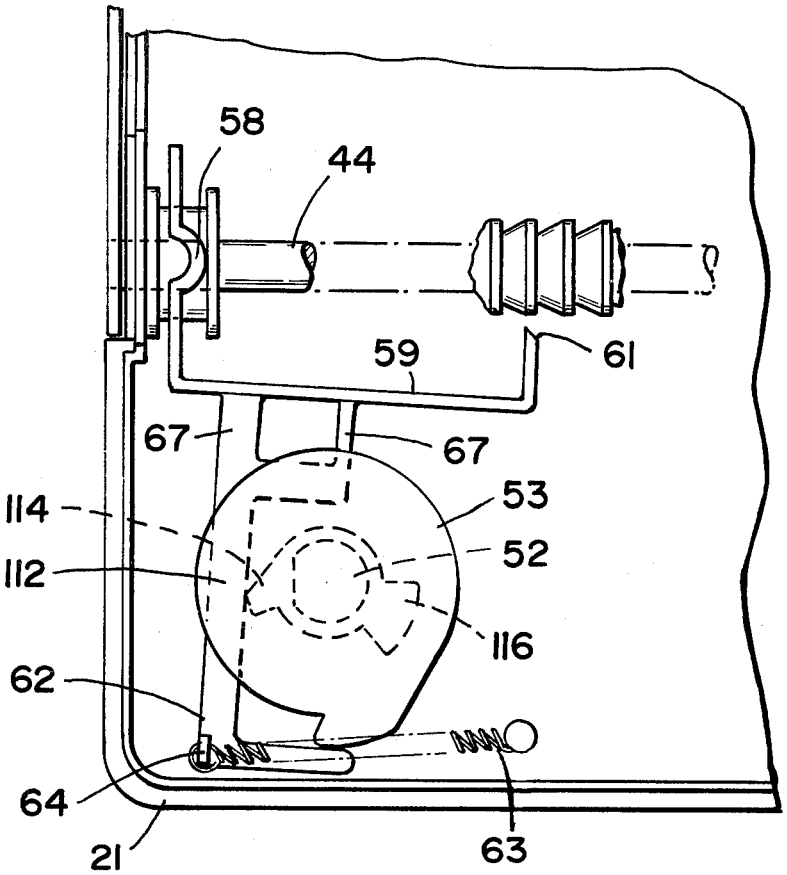

FIG. 12 is a detailed view of the cam and plate assembly of the present invention, shown in the unlocked position.

Figure 13:
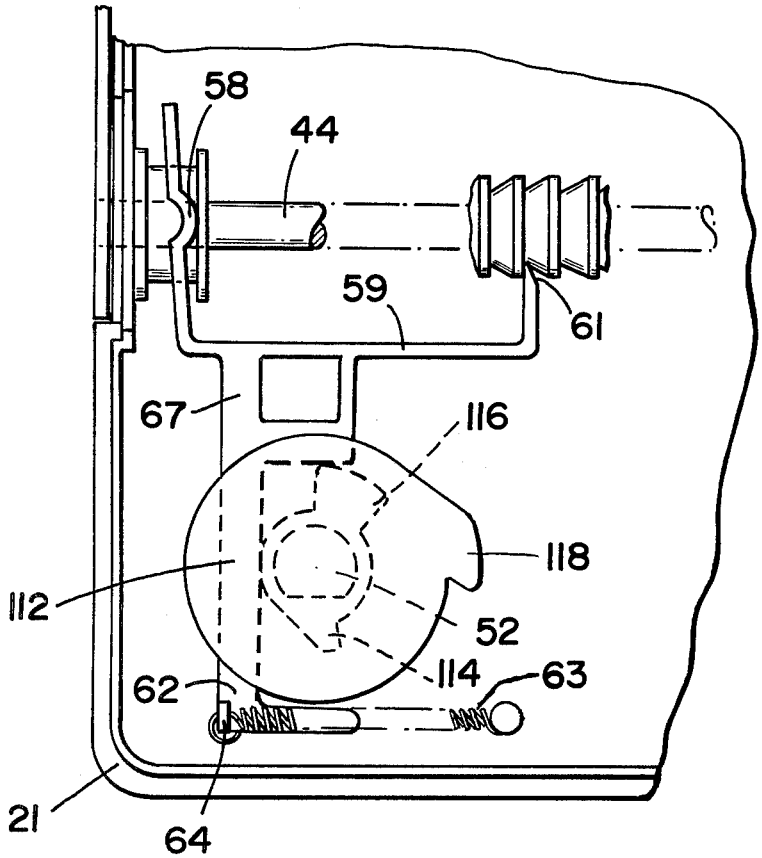

FIG. 13 is a detailed view of the cam and plate assembly of the present invention shown in the locked position.

DESCRIPTION OF THE PREFERRED EMBODIMENT

Figure 1:
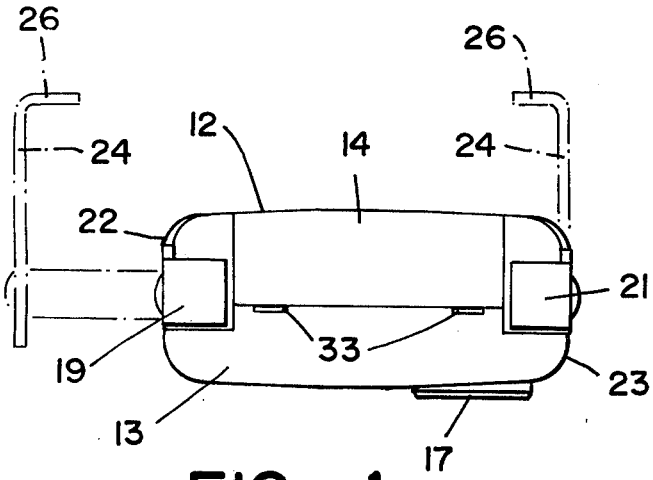
FIG. 1 is an end view of the alarm device of the present invention.
Figure 2:
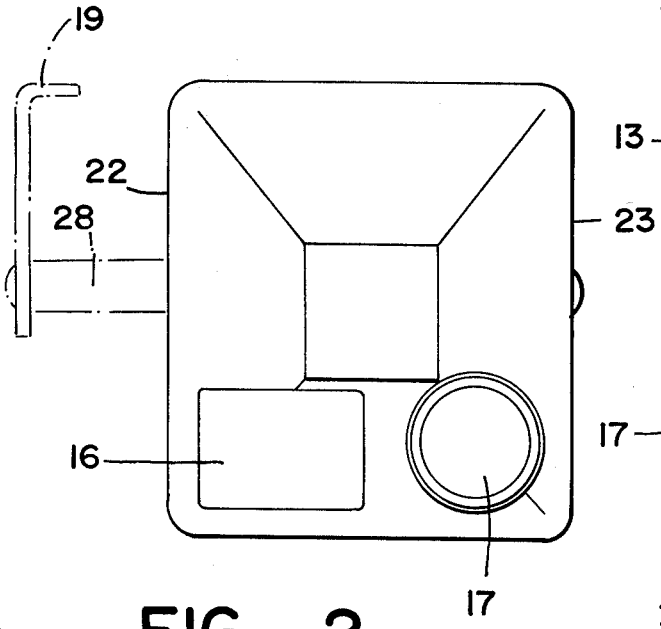
FIG. 2 is a top view of the alarm device of the present invention.

As shown in FIG. 1, the alarm device of the present invention includes a housing 12 which is composed of confronting front and rear portions 13 and 14. The assembled front and rear portions define a generally rectangular housing which is dimensioned to be received and stored in the pocket of a jacket, parka, or the like. The front of the housing includes an identification panel 16 (FIG. 2), and a raised annular shoulder 17 in which is disposed a key operated lock device. A pair of jaws 19 and 21 are pivotally secured to the opposed sides 22 and 23 of the housing. Each jaw included a first portion 24 parallel to its respective side of the housing, and a distal end portion 26 extending perpendicularly therefrom and parallel to the end 27 (FIG. 5) of the housing. The jaws when retracted are retained adjacent to the housing by detents disposed beneath the end portions 26.

Figure 3:
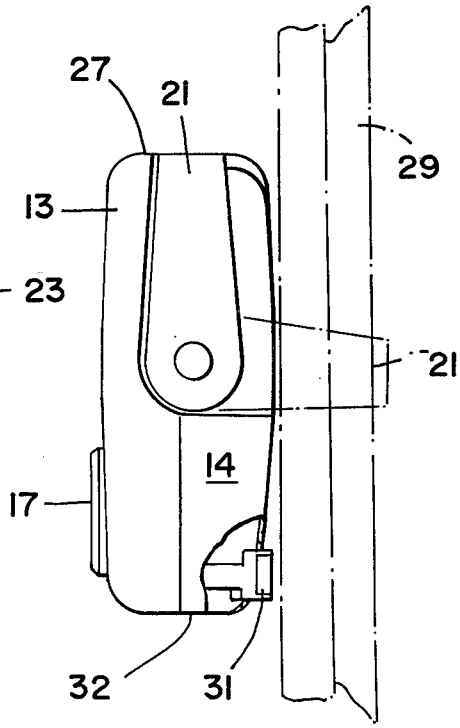
FIG. 3 is a side view of the alarm device of the present invention, secured to an article to be protected.

Each jaw is pivotable away from the housing to engage the article to be protected. The jaw 19 is mounted on an extendable, lockable ratchet shaft 28 (FIGS. 2, 5, and 7) so that it may be translated away from the housing to encompass the protected article. Thus, as shown in FIGS. 3 and 4, the jaws may be rotated and extended to grasp a pair of skis or the like. The housing portions 13 and 14 are joined together by a screw 31 at the lower end 32 of the housing, as well as a hinge 33 at the upper end 27 of the housing. It may be appreciated that the screw 31 is not accessible when the device is secured in place as shown in FIG. 3.

Secured within the housing at the upper end 27 thereof is a battery retainer 34, as shown in FIG. 5, which holds the four penlight cells which power the alarm portion of the invention. Adjacent and below the battery holder is the ratchet shaft 28. As shown in FIG. 7, the shaft includes a smooth, cylindrical portion 36 which is extendable through a hole 37 in the housing side. A cresent ring 38 retained in an annular groove 39 in the shaft limits the external extension of the shaft 28. A plurality of conical ratchet projections 42 are spaced from the groove 39 to the end 41 fo the ratchet shaft.

The ratchet shaft is provided with an axially disposed hole 43 which receives a pivot shaft 44 in freely rotating and translating fashion. The pivot shaft 44 includes an enlarged shoulder 46 adjacent to the side 23 of the housing front portion, and a cresent ring 47 secured thereabout which retains the pivot shaft within the housing. The jaw 21 is joined to the exterior portion of the pivot shaft. The shoulder 46 includes a radially extending flange 48 spaced apart from the cresent ring 47 and defining therebetween a pawl pivot bearing surface 49.

Disposed in the housing, in the corner defined by the side 23 and the end 32 is the key lock 17, adjacent to the sound transducer or horn 56. As shown in FIG. 8, a cylindrical recess 51 formed in the housing front portion 13 receives the lock assembly, with the lock shaft 52 extending through a hole in the rear of the recess. Joined to the end of the lock shaft is an eccentric cam 53, which is spaced from the interior surface of the recess by an eccentric cam shoulder 55 to define a gap 54 therebetween.

The alarm device also includes a pawl 55 for selectively engaging the ratchet teeth and for linking the lock mechanism to the ratchet. The pawl includes a shoulder engaging portion 57 which is provided with tines which straddle the shoulder 49 of the pivot shaft. The tines include a U-shaped bend 58 which bears against the flange 48 for reasons which will be made apparent in the following description. Joined to the portion 57 is a laterally disposed rod 59, which terminates at the distal end thereof in a ratchet detent 61.

The pawl includes a plate 62 having a slot therein which receives the key lock shaft 52 therethrough. The plate 62 is retained between the cam 53 and the lock recess 51, in the gap 54 (FIG. 8). A helical extension spring 63 is secured between a dog 64 on the plate 62, and a post 66 within the housing, as shown in FIG. 5. The spring biases the plate 62 in the counterclockwise direction. The plate 62 is joined to the pawl rod 59 by a pair of arms 67 extending therebetween. Thus rotation of the plate about the axis of the lock shaft 52 effects rotation of the pawl rod about the pawl bearing surface 49, this rotation being transverse to the pivot shaft 44.

The cam 53 includes a dog extending therefrom into the gap 54 which interacts with the plate 62 to rotate the plate about the bearing surface 49 as the lock is rotated. Thus engagement of the detend 61 and the teeth 42 is controlled by the lock.

As shown in FIG. 12 and FIG. 13, the dog extending into the gap 54 includes a pair of lobes 114 and 116 projecting from a central annulus. With reference to FIG. 12, when the cam is rotated fully clockwise, the lobe 114 impinges on the web portion 112 of the plate 62. This impingement urges the plate to rotate clockwise about the shoulder of the pivot shaft, maintaining the ratchet detent 61 out of engagement with the ratchet and permitting the members 19 and 28 to extend freely.

When the cam 53 is rotated to its fully counterclockwise position, as shown in FIG. 13, the lobe 114 is no longer in engagement with the web 112. However, the cam lobe 116 is brought into impingement with the lateral surface of the plate 62, urging the plate to rotate counterclockwise and engage the ratchet detent with the ratchet teeth. This action locks the shaft 28 and the clamping member 19. This rotation into engagement of the racket is aided by the spring 63, which biases the plate 62 in the counterclockwise direction. It should be noted that the cam 53 includes the radially extending lobe 118, the circumferential surface 74 of which impinges on the leaf switch 69 shown in FIG. 9.

The post 66 also supports the switch 69, as shown in FIG. 9, which arms the electronic circuit of the alarm device. The switch includes an upper leaf member 71 secured on the post 66 and separated from a lower leaf member 72 by an insulating washer 73. The upper leaf member impinges on the peripheral surface 74 of the cam 53, and is urged by rotation of the cam to contact the lower leaf member and complete the circuit which arms the device. The member 71 is composed of resilient spring material which will break contact when not otherwise urged by the cam.

The present invention also includes an alarm circuit 76 (FIG. 11) which is mounted on a printed circuit board 77 secured to a medial interior portion of the housing front member, as shown in FIG. 6. The circuit is powered by a battery 78, which is retained in the battery holder 34, connected through the arming switch 69. The circuit is triggered by a normally closed motion sensing switch 79, which, in a non-alarm condition, maintains junction 91 at a ground potential. The base of transistor 95 is connected through diode 96 to the junction 91, so that transistor 91 is non-conductive when the switch 79 is closed. Transistor 80, with its emitter-collector voltage biased by resistors 81 and 82, and its base connected to positive voltage through resistors 83 and 84, is conductive and operating near saturation. Transistor 90, a PNP transistor, is held non-conductive by its base connection through resistor 91 to junction 97, applying a positive voltage to its base.

If an alarm condition is created by the opening of the switch 79, junction 91 will be raised from ground potential, and the resulting position voltage applied from resistor 92 to the base of Darlington transistor pair 95 will cause it to turn conductive. As transistor 95 conducts, it causes junction 97 to decrease in potential, creating a negative voltage spike at junction 97. This negative spike is transmitted through resistor 91 to the base of transistor 90, causing it to become forward biased and conductive. As transistor 90 becomes conductive, it applies almost all of the battery voltage to the horn 56, causing a loud, jarring audio alarm signal. The capacitor 89, connected in parallel with the horn, smooths the voltage spikes generated thereby to reduce interference within the circuit.

The negative voltage pulse created at junction 97 is also transmitted through capacitor 90 and resistor 83 to the base of transistor 80, causing that transistor to reverse bias and become non-conductive. As transistor 90 turns off it creates a path through resistor 81, junction 93, and resistor 85 which allows bias current to latch transistors 95 in saturation. This maintains transistor 90 forward biased to maintain actuation of the horn. At the same time capacitor 98 is receiving a positive charge through the large resistor 84. When this charge reaches a sufficiently high positive potential, it acts through resistor 83 to forward bias transistor 80, turning it on again. This action negative biases the diode and reduces the potential at junction 93 almost the the ground, removing the latch condition for transistors 95. The negative potential at junction 93 charges capacitor 86 negatively and also reverse biases transistors 95, turning them off. The non-conductance of transistors 95 raises the potential of junction 97, causing transistor 90 to turn off, and ending actuation of the timing circuit which controls the alarm portion of the cycle. Component values are chosen so that the alarm remains actuated for approximately 1-2 seconds.

It may be noted that the negative charge of capacitor 86 prevents immediate re-actuation of transistors 95. Because of this, the capacitor 86 in conjunction with resistors 85, 87, and 81, and diode 96 form an RC timing circuit which controls the minimum off time of the alarm signal. If, after the negative charge has leaked from capacitor 86, the switch 79 is again closed, the alarm cycle will not continue. However, if the switch remains open or is reopened, the cycle will start anew. The capacitors 99 and 88, in conjunction with capacitor 89 and resistor 92, provide important noise filtering to eliminate interference within the circuit.

The motion-sensing switch 79, shown in FIG. 10, may also be mounted on the printed board. It comprises a pair of opposed end caps 101 of conductive material, separated by a cylindrical insulating spacer 102. Each end cap includes a cylindrical body portion 103 which receives the spacer with a press fit, and which includes an axially disposed hole 104 in the interior portion thereof. Disposed between the end caps within the spacer is a spindle contactor 106, which includes a pair of contact pins 107 extending from the end thereof. The point-to-point distance is less than the span of the interior cavity formed by the holes 104 into which the pins extend. Thus the pins tend to rest on the annular interior surface of the holes 104, completing a circuit between the end caps. Any motion imparted to the device will jostle the switch sufficiently to cause the contactor to break the circuit momentarily. The circuit is completed through tab terminals 108 which connect the end caps to the alarm circuit described in the foregoing.

OPERATION OF THE PREFERRED EMBODIMENT

The alarm device of the present invention is normally stored with the jaws 19 and 21 detained on the upper end of the housing, as shown in FIG. 1. To secure the device to an article to be protected, the key lock 17 is rotated to the off position. The cam portion 54 associated with the lock shaft rotates the pawl detent out of engagement with the ratchet, so that the jaw 19 may be fully extended on the ratchet shaft to encompass the article. The key is then rotated in the lock to the set position, freeing the pawl from the cam and allowing the spring 63 to urge the pawl detent to engage the ratchet. the switch 69 is not closed, however, so that the manipulations required to close the jaws will not set off the alarm. As the jaws are closed about the article, the pawl detent retains the ratchet to lock the jaw clamped about the article.

The key lock is then rotated to the armed position, in which the switch 69 is closed by the cam portion 74 while the ratchet engagement is maintained. The device is thus armed, and will sound an alarm if the switch 79 is opened. It should be noted that any force which tends to separate the jaws will force the pawl rod to rotate about the pawl bearing 49, drived the curved position 58 into the flange 48. This action drive the pawl detent harder against the ratchet, thereby creating an even higher locking force between the detent and ratchet.

Thus it may be appreciated that the present invention provides a compact alarm device which is easily and tenaciously secured to an article, and which emits a loud jarring, pulsating alarm when the article is removed. Furthermore, the alarm will only continue if the motion continues, so that incidental motion will not maintain a false alarm.

I claim:

1. A theft preventing alarm device for a valuable article, comprising:

motion sensing means for sensing movement of said valuable article and generating an alarm actuating signal in response to said movement, alarm means, connected to said motion sensing means, for generating an alarm signal upon receiving said alarm actuating signal, a pair of pivotable clamping jaws variably spaced apart to secure said device to said valuable article, retaining means for releasably retaining said jaws in a predetermined spaced relationship, and lock means for both arming said alarm means and actuating said retaining means.

2. The device of claim 1, wherein said motion sensing means includes a motion sensing switch having a hollow cylindrical insulating member and a pair of conductive end caps secured in the opposed ends of said insulating member.

3. The device of claim 2, wherein said motion sensing switch includes a conductive contactor disposed within said insulating member, said contactor including a pair of opposed pins extending therefrom and adapted to bridge said end caps in normally closed switch fashion.

4. The device of claim 3, wherein said contactor includes a cylindrical body, said pins extending from opposed ends of said cylindrical body.

5. The device of claim 1, wherein one of said pair of clamping jaws is secured to an axially extendable shaft.

6. The device of claim 5, wherein said axially extendable shaft includes a plurality of ratchet teeth spaced along a portion thereof.

7. The device of claim 6, wherein said axially extendable shaft includes an axially disposed hole in one end thereof, and further including a pivot shaft, received, in said hole, on which said axially extendable shaft may freely extend and rotate.

8. The device of claim 7, wherein the other of said pair of clamping jaws is secured to one end of said pivot shaft.

9. The device of claim 1, wherein said lock means includes a key operated lock device having a lock shaft rotatable by the proper key.

10. The device of claim 9, further including a cam member secured to said lock shaft.

11. The device of claim 10, further including an arming switch connected to said alarm means and actuated by said cam member.

12. The device of claim 10, wherein said retaining means includes a pawl member operatively associated with said cam member.

13. The device of claim 12, wherein one of said pair of clamping jaws is secured to an extendable ratchet member, and said pawl member includes a detent extending therefrom for selectively engaging said ratchet member and limiting the extension thereof.

14. The device of claim 13,, wherein said retaining means includes spring means for biasing said pawl detent to engage said ratchet member.

15. The device of claim 1, wherein said alarm means includes an astable multivibrator which operates cyclically upon receipt of said alarm actuating signal to actuate a sound transducer for a first predetermined period, and to de-actuate said sound transducer for a second predetermined period during which said second period said alarm actuating signal cannot cause reactuation of said sound transducer.

* * * * *